US011193304B2

(12) United States Patent
Riesel

(10) Patent No.: US 11,193,304 B2
(45) Date of Patent: Dec. 7, 2021

(54) KEY, LOCK, AND LOCKING SYSTEM

(71) Applicant: EVVA SICHERHEITSTECHNOLOGIE GMBH, Vienna (AT)

(72) Inventor: Michael Riesel, Weida (DE)

(73) Assignee: EVVA SICHERHEITSTECHNOLOGIE GMBH, Vienna (AT)

( * ) Notice: Subject to any disclaimer, the term of this patent is extended or adjusted under 35 U.S.C. 154(b) by 240 days.

(21) Appl. No.: 16/333,679

(22) PCT Filed: Oct. 12, 2017

(86) PCT No.: PCT/EP2017/076012
§ 371 (c)(1),
(2) Date: Mar. 15, 2019

(87) PCT Pub. No.: WO2018/069427
PCT Pub. Date: Apr. 19, 2018

(65) Prior Publication Data

US 2019/0264464 A1 Aug. 29, 2019

(30) Foreign Application Priority Data

Oct. 13, 2016 (DE) ..... 202016105750.7

(51) Int. Cl.
*E05B 19/00* (2006.01)
*E05B 19/26* (2006.01)
(Continued)

(52) U.S. Cl.
CPC ..... *E05B 19/0041* (2013.01); *E05B 19/0011* (2013.01); *E05B 19/0017* (2013.01);
(Continued)

(58) Field of Classification Search
CPC ..... E05B 19/0011; E05B 19/0017; E05B 19/0023; E05B 19/0029; E05B 19/0041;
(Continued)

(56) References Cited

U.S. PATENT DOCUMENTS 424,412 A * 3/1890 Fischer ..... E05B 35/06 70/407
616,751 A * 12/1898 Vedder et al. ..... E05B 35/06 70/493
(Continued)

FOREIGN PATENT DOCUMENTS

CN 1865639 A 11/2006 ..... E05B 27/00
CN 1963122 A 5/2007 ..... E05B 19/06
(Continued)

OTHER PUBLICATIONS

Notification Concerning Transmittal of International Preliminary Report on Patentability (Chapter I of the Patent Cooperation Treaty), in English, dated Apr. 25, 2019, which was issued by the International Bureau of WIPO in Applicant's corresponding international PCT application having Serial No. PCT/EP2017/076012, filed on Oct. 12, 2017.
(Continued)

*Primary Examiner* — Christopher J Boswell
(74) *Attorney, Agent, or Firm* — Bodner & O'Rourke, LLP; Gerald T. Bodner; Christian P. Bodner

(57) ABSTRACT

A key, comprising: a key head; and a key shank (10), characterized in that the key shank (10) includes a torsion section (20) that is formed, in particular cold formed, along a longitudinal axis (L) at least in sections, wherein the key shank (10) includes a base cross-section (26) in a transition portion to the torsion section (20), wherein a cross-section (30) of the key shank (10) protrudes at least in sections
(Continued)

beyond the base cross-section (26) in the torsion section (20) in a direction towards the key tip (70).

17 Claims, 4 Drawing Sheets

(51) Int. Cl.
*E05B 35/06* (2006.01)
*E05B 35/00* (2006.01)

(52) U.S. Cl.
CPC ..... *E05B 19/26* (2013.01); *E05B 35/001* (2013.01); *E05B 35/06* (2013.01)

(58) Field of Classification Search
CPC .. E05B 19/0047; E05B 19/0076; E05B 19/26; E05B 35/00; E05B 35/001; E05B 35/06
See application file for complete search history.

(56) References Cited

U.S. PATENT DOCUMENTS 842,834 A * 1/1907 Hurdle ..... E05B 55/005 70/473
1,161,760 A * 11/1915 Baird ..... E05B 19/00 70/407
1,280,633 A 10/1918 Baird ..... 70/492
2,062,010 A * 11/1936 Neer ..... E05B 35/06 70/493
2,123,993 A * 7/1938 Daniels ..... E05B 35/00 70/149
4,454,735 A * 6/1984 Huang ..... E05B 35/06 70/346
6,925,844 B2 * 8/2005 Liu ..... E05B 35/06 70/358
7,870,771 B2 * 1/2011 Mueller ..... E05B 29/00 70/409
10,210,690 B1 * 2/2019 Foran ..... E05B 19/0082
10,337,208 B2 * 7/2019 Chen ..... E05B 35/06
2002/0012802 A1 * 1/2002 Motegi ..... E05B 19/26 428/423.1
2004/0172992 A1 9/2004 Huang ..... 70/358

FOREIGN PATENT DOCUMENTS

CN 101025060 A 8/2007 ..... E05B 17/14
CN 202164881 U 3/2012 ..... E05B 15/08
DE 69904408 T2 4/2003 ..... E05B 19/00
FR 2776327 A1 9/1999 ..... E05B 19/00
WO WO02088497 A1 11/2002 ..... E05B 35/06

OTHER PUBLICATIONS

English translation of the International Preliminary Report on Patentability (Chapter I of the Patent Cooperation Treaty), dated Apr. 16, 2019, which was issued by the International Bureau of WIPO in Applicant's corresponding international PCT application having Serial No. PCT/EP2017/076012, filed on Oct. 12, 2017.
Written Opinion of the International Searching Authority, in English, dated Jan. 22, 2018, which was issued by the International Bureau of WIPO in Applicant's corresponding international PCT application having Serial No. PCT/EP2017/076012, filed on Oct. 12, 2017.
International Search Report, in English, dated Jan. 22, 2018, which was issued by the International Bureau of WIPO in Applicant's corresponding international PCT application having Serial No. PCT/EP2017/076012, filed on Oct. 12, 2017.

* cited by examiner

KEY, LOCK, AND LOCKING SYSTEM

The invention relates to a key with a key head and a key shank according to the preamble of claim 1 or 2. The invention furthermore relates to a lock, in particular for receiving a key, according to the invention, wherein the lock includes a lock cylinder with a cylinder core according to the preamble of claim 11. The invention furthermore relates to a locking system including a key according to the invention and a lock according to the invention.

Numerous keys and locking systems are known in the art that are configured to provide increased burglar resistance. DE 699 04 408 T2 discloses a key with a movable pin and a safety rotation cylinder and a lock configured therewith. According to this solution, a key shall be provided for a safety rotation cylinder wherein the key includes a movable latch which makes copying the key configured with the latch more difficult so that increased safety is provided for the user.

Since criminals always come with new ways to manipulate locking systems, it is necessary to continuously improve keys and locking systems.

Thus, it is an object of the invention to provide an improved key with a key head and a key shank that provides a multitude of coding options. Furthermore, it is an object of the invention to provide an improved lock which is improved with respect to manipulation safety. It is another object to provide an improved locking system that includes a key according to the invention and a lock according to the invention. The new locking system shall furthermore provide a new quality of safety against manipulation of locking systems.

The object is achieved by the key with the feature combinations according to claim 1 or 2 in combination with the lock through the feature combination according to claim 11 and in combination with the locking system with the feature combination according to claim 16. The dependent claims relate to useful embodiments and improvements.

A key with a key head and a key shank is used as a basis, wherein the key shank includes a torsion section along a longitudinal axis that is in particular cold-formed at least in sections, wherein the key shank has a base cross-section in a transition portion to the torsion section, wherein the cross-section of the key shank in the torsion section protrudes beyond the base cross-section at least in sections. The transition portion to the torsion section represents a boundary portion between a torsion section and a non-deformed section of the key shank.

The torsion section is a section that is generated by a rotation of the section. The rotation of the section is performed about the longitudinal axis of the key shank. The torsion section, therefore, designates a twisted section of the key shank, wherein the torsion section is generated by a torsion torque.

According to the invention, the torsion section provides an additional coding option in combination with the key shank. It is possible that the key shank has the so-called base cross-section before the torsion section is formed as well as after forming the torsion section. The base cross-section is formed in sections of the key shank that are not twisted and that are not subjected and have not been subjected to a torsion torque.

Advantageously the torsion section is flattened or pleated before forming, this means before its actual fabrication. Put differently, the key shank is flattened or pleated in a first step in a section that shall subsequently include the torsion section, wherein the flattened or pleated section is rotated or twisted about the longitudinal axis of the key shank in a second step.

In the torsion section the key shank also has at least one cross-section, wherein the at least one cross-section protrudes beyond the base cross-section at least in sections. The base cross-section and/or the cross-section of the key shank are formed by a cross-section orthogonal to the longitudinal axis. The base cross-section and/or the additional cross-section of the key shank in the torsion section can be configured essentially rectangular, in particular square. In the torsion section edges and/or side surfaces of the key shank can be rotated about the longitudinal axis of the key shank so that they protrude beyond the base cross-section. A protrusion beyond the base cross-section is evident in particular from a top view of the key tip in a direction along the key head.

In a particularly advantageous embodiment of the invention, the torsion section of the key shank is a cold-formed torsion section. Put differently, initially a key shank is provided that is configured in particular straight or flat along the longitudinal axis. Forming the torsion section, in particular imparting a torsion torque upon this section of the key shank is performed, e.g., by cold forming. Cold-forming designates a plastic forming of metals below a recrystallization temperature. The cold forming can be performed in particular by clamping the key shank and subsequently twisting the key shank along its longitudinal axis.

According to another independent aspect of the invention, it is possible that the key shank includes a cold-formed torsion section at least in a section along its longitudinal axis, wherein a length and twist angle of the key shank is variable in the torsion section in a direction towards the key tip.

With respect to the torsion section and in particular the cold formed torsion section the preceding description apply.

It is possible that the torsion section is configured as a control curve and/or includes a control curve. This applies for both independent aspects with respect to the key.

For both independent aspects the following embodiments can be implemented:

A least one flank of the key shank can protrude beyond the base cross-section. This flank that protrudes beyond the base cross-section or an edge or side surface that protrudes beyond the base cross-section provides an additional coding option.

In one embodiment of the invention it is possible that the key shank includes at least one additional coding element. The coding element can be advantageously configured as a recess in an edge. Advantageously, the key shank includes plural recesses. In another embodiment of the invention, it is possible that plural, in particular all edges, in particular all exterior edges, of the key shaft include the recesses. The recesses can have a circular, semi-circular or elliptical or semi-elliptical shape, or they can have a rectangular or square shape.

In another embodiment of the invention, it is possible that the key shank includes at least one profile element, wherein the profile element also includes a torsion in the torsion section. The profile element can be advantageously provided as a longitudinal groove. A longitudinal groove of the key shank advantageously runs from a tip of the key shank in a direction towards the key head. It is possible that the longitudinal groove extends completely to the key head. It is also possible that an offset section is formed between the key head and an end of the longitudinal groove. Since a torsion section is formed at the key shank the profile element, in particular the longitudinal groove in the torsion section, also has a twist. Put differently, the profile element is twisted about the longitudinal axis.

In another embodiment of the invention, the key shank can include at least two profile elements. The at least two profile elements extend parallel to one another in a first section that starts at the key head. In the adjoining torsion section the profile elements, in particular the longitudinal grooves, are twisted about the longitudinal axis of the key shank. Advantageously, the profile elements, in particular the longitudinal grooves, are arranged in a double-helix shape. The shape of the double helix is formed by two helices that extend about each other. This corresponds to the geometric configuration of a double threaded screw. The helices can be arranged, e.g., offset from each other by a half pitch. Furthermore, one of the helices can be offset by half a rotation. The two helices advantageously have a constant distance from each other and do not touch each other.

In another embodiment of the invention, the key tip is formed in the torsion section. This means that the key tip is formed as a portion of the torsion section. Thus, the key tip is also twisted about the longitudinal axis of the key shank. The cross-section of the key tip can protrude beyond the base cross-section of the key shank. This in turn provides another coding option.

It is appreciated that the tip of the key shank does not have to be configured pointed. It is also conceivable that the key tip is configured as a flat surface.

In particular, the key shank can be made from an elastic material, in particular from spring steel or polyurethane, particularly advantageously from PUR D 44. An elastic material of this type has the effect that the key shank is torsion adapted to the cylindrical core during insertion.

In another embodiment of the invention, the key shank can be rotatably supported in the key head.

It is possible that the key shank has different diameters or different cross-sections. The different cross-sections can also be formed in sections of the key shaft that have no torsion section.

The torsion section of the key shank can be configured variable. The geometry of the torsion section can differ with respect to pitch and/or arc length, and/or thread height and/or torsion.

Another aspect of the invention relates to a lock, in particular for receiving a key according to the invention, wherein the lock includes a lock cylinder with a cylindrical core.

According to the invention, at least one decoding element is configured in the cylindrical core wherein the at least one decoding element has an arcuate, in particular helix-shaped contour, or is arranged at least in sections on an arcuate, in particular, helical path. The helical contour can also be designated as a curved contour. The helical path can also be designated as a curved path.

The path that is in particular helical can extend along a base profile of the cylindrical core. Advantageously, plural decoding elements, configured in particular as scanning elements, are arranged on a particularly helical path. The scanning elements can, e.g., be pins.

It can be furthermore conceivable that at least one decoding element is configured as a curved, in particular helical, protrusion, or as an arcuate, in particular helical, protrusion.

The lock is used in particular for scanning the key according to the invention, in particular the key shank configured according to the invention. The torsion section of the key shank is matched in the lock by complementary elements, in particular decoding elements. A geometric match between the key shank, in particular between the torsion section of the key shank and the cylindrical core of the key, facilitates a three-dimensionally fitted insertion of the key shank into the cylindrical core. Thus, it is possible to facilitate a spatial, this means at least three-dimensional, coding function.

The lock can furthermore include a coupling element that scans the tip, in particular the tip associated with the torsion section. Advantageously, the coupling element is configured so that the tip of the key shank is scannable on different lengths. The decoding elements, in particular the scanning elements, are radially arranged relative to the base profile of the cylindrical core.

Another aspect of the invention relates to a locking system with the key according to the invention and a lock according to the invention. This yields similar advantages as already described in conjunction with the key according to the invention and/or the lock according to the invention.

The invention is subsequently described based on embodiments with reference to schematic drawing figures, wherein.

Figure 3A:
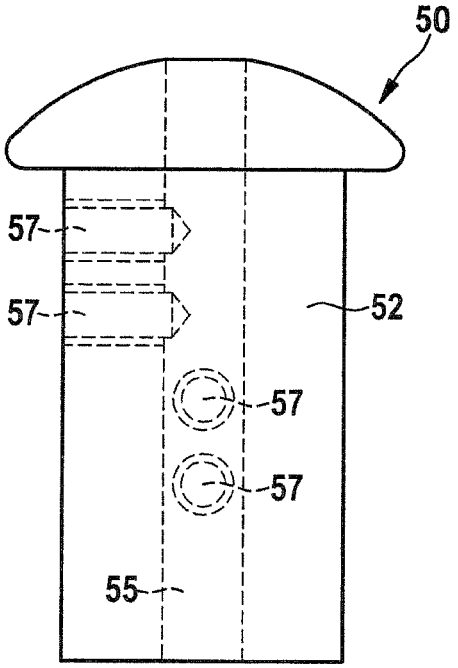
Figure 3B:
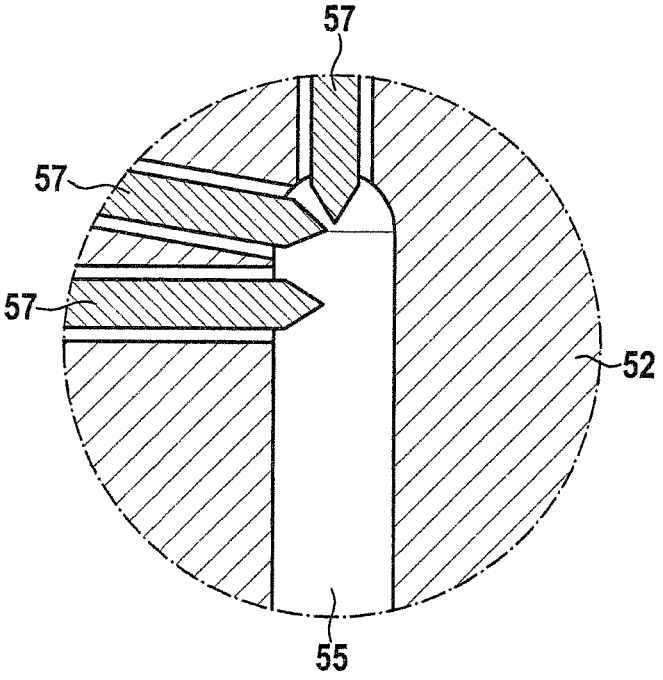
Figure 4A:
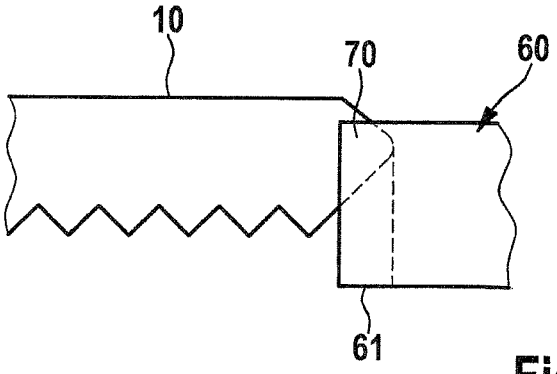
Figure 4B:
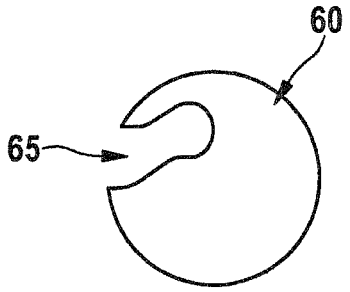
Figure 4C:
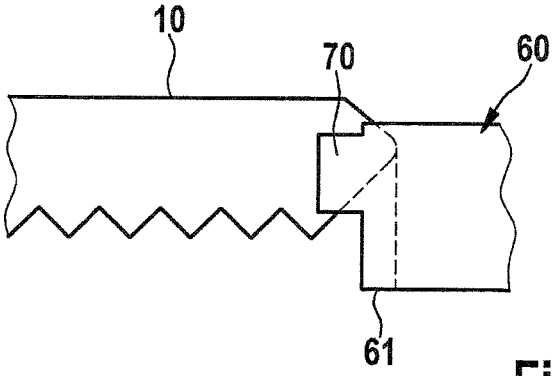

FIGS. 3*a* and 3*b* illustrate various views of a lock according to the invention, in particular of a locking cylinder;

FIGS. 4*a* through 4*c* illustrate various views of a coupling element of a lock according to the invention, in particular of a locking cylinder.

In the subsequent description, identical reference numerals are used for identical or like components.

Figure 1:
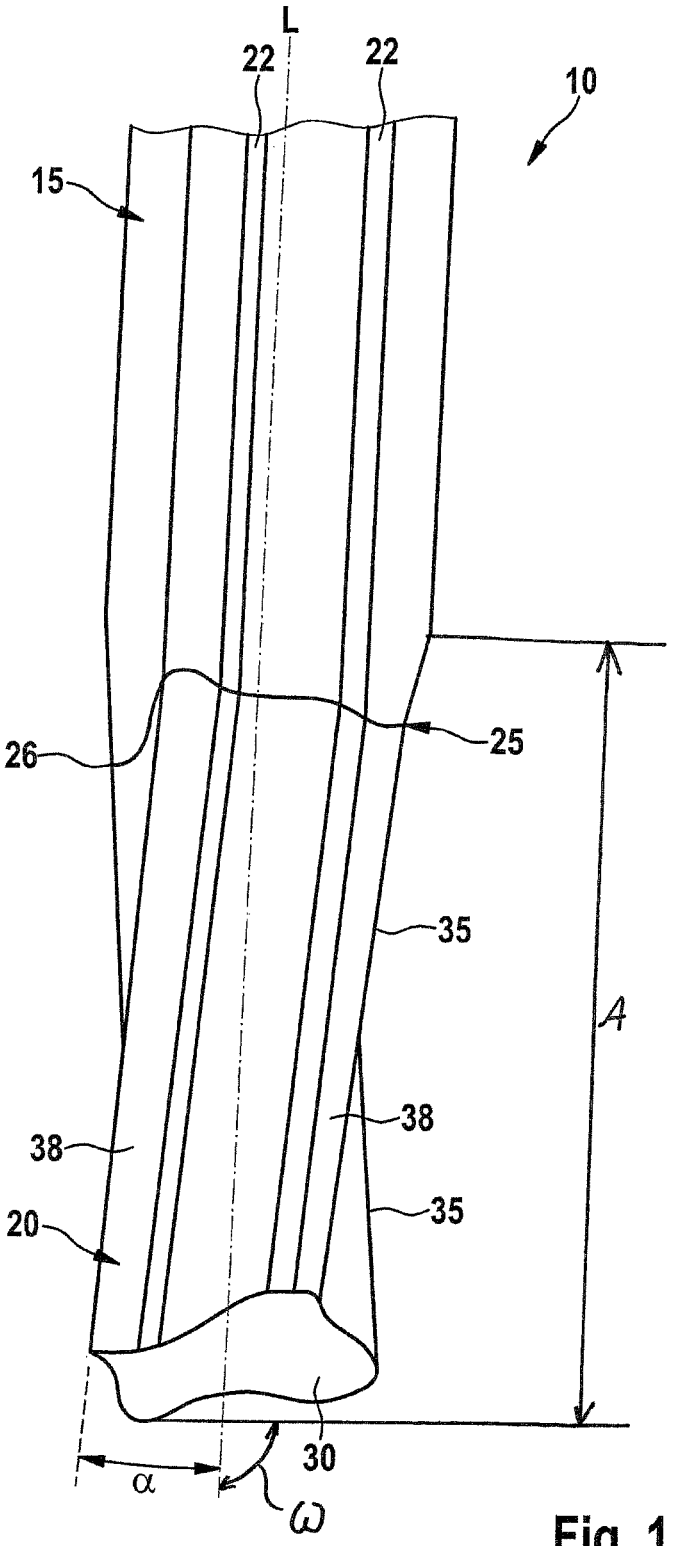
FIG. 1 illustrates a first embodiment of the key according to the invention.

As evident from FIG. 1, a key shank 10 extends along a longitudinal axis L. The key shank 10 includes a first section 15 that is adjacent to a non-illustrated key head. A torsion section 20 adjoins the first section of the key head. The key shank 10 furthermore includes profile elements 22 that are configured in the illustrated embodiment as longitudinal grooves. The longitudinal grooves are illustrated in the first section 15 and also in the torsion section 20. The torsion section 20 is a section which includes a twist of the section of the key shank 10 about the longitudinal axis L. Advantageously, the torsion section 20 is cold-formed, this means produced by cold forming.

At a beginning of the torsion section 20 a base cross-section 26 is formed. The base cross-section is not illustrated in FIG. 1. Only a sectional plane of the base cross-section 26 is visible. Also the cross-section of the first section 15 can serve as the base cross-section, this mean the base cross-section can be formed starting from the key head. Since the cross-sectional surface decreases in the instant embodiment from the first section 15 in a direction towards the torsion section 20, the cross-section at a beginning 25 of the torsion section 20 is designated as the base cross-section in the subsequent description.

The cross-section in the additional torsion section 20, this means starting from a beginning of the torsion section 25 in a direction towards the key tip, can protrude beyond the base cross-section at least in sections. The illustrated cross-section 30 is referred to in an exemplary manner. The cross-section 30 is not identical to the base cross-section 26. The cross-section 30 is rather arranged twisted relative to the base cross-section 26 about the longitudinal axis L. Thus, sections of the cross-section 30 protrude beyond the surface of the base cross-section 26.

The profile elements 22 are arranged parallel to each other in the first section 15 of the key shank 10. In the torsion section 20 the profile elements 22 are also arranged twisted and have a torsion. Put differently, the profile elements 22 can have a helical shape in the torsion section 20. In particular, the two profile elements 22 can have a double helix shape.

The key shank 10 can be made from elastic material, in particular spring steel or polyurethane, particularly advantageously PUR D 44.

The edges 35 or the side shanks 38 of the key shank 10 in the torsion section 20 can also have a helical shape. Portions about the edges 35 are designated as side flanks 38. These flanks 38 and/or edges 35 of the key shank 10 protrude at least in sections beyond the base cross-section 26 of the key shank 10.

An additional coding option is provided by the torsion section 20 and elements of the key shank that are also twisted about the longitudinal axis L, like, e.g. the twisted profile elements 22, twisted edges 35 and twisted flanks 38. This facilitates a three-dimensional coding function.

FIG. 1 furthermore illustrates that a length A and a rotation angle ω of the key shank 10 in the portion direction 20 are variable in a direction towards the key tip.

Figure 2:
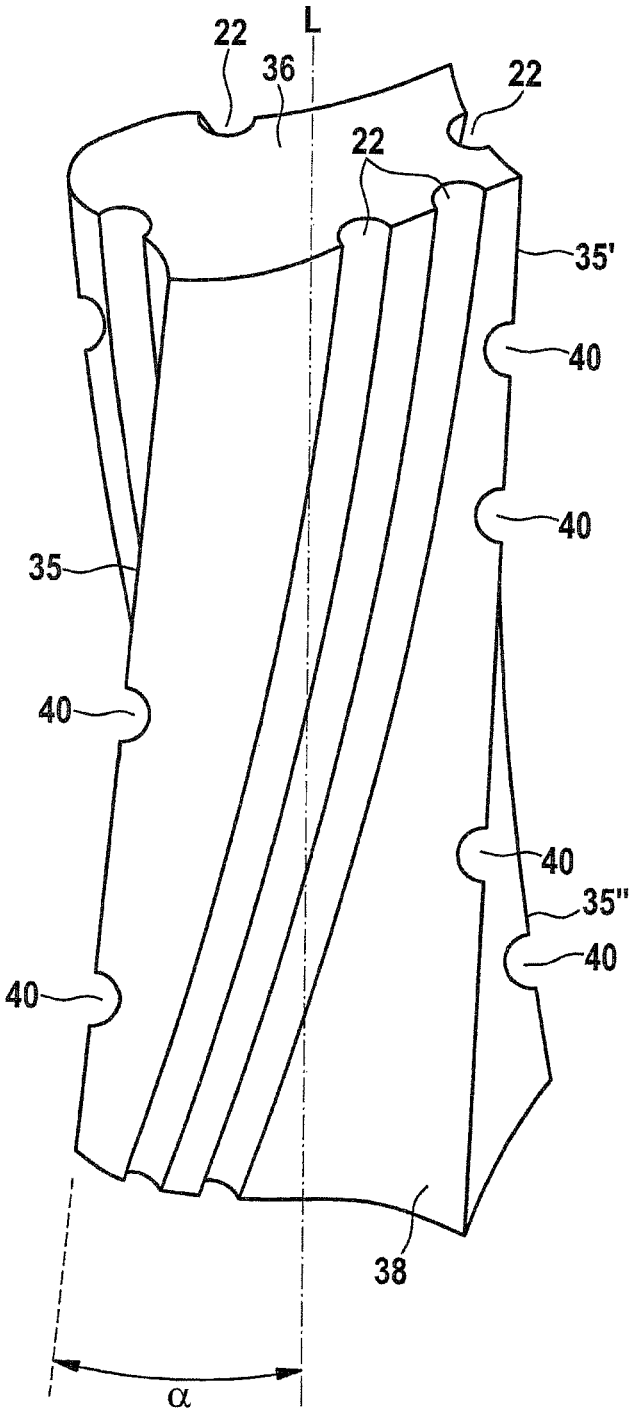
FIG. 2 illustrates another embodiment of the key according to the invention.

FIG. 2 illustrates another embodiment of a key shank 10, in particular of a torsion section 20. In addition to profile elements 22 configured as longitudinal grooves, coding elements 40 are configured. The coding elements 40 are configured as recesses in edges 35. Advantageously a different number of coding elements 40 is configured at a first edge 35 and at a second edge 35'. A distance between the individual coding elements 40 varies as well.

It is evident from the view according to FIG. 2 that the profile elements 22 have an arc shape or a helix shape. Also the flanks 38 are configured helix shaped or arc shaped. Put differently, this yields a twisted arrangement of the profile elements 22, the coding elements 40 and of the edges 35 and the flanks 38.

The torsion section 20 of the key shank 10 can be configured variable. In particular it is possible in an embodiment that different angles α are formed in conjunction with the profile 22 elements relative to the longitudinal axis.

FIGS. 3*a* and 3*b* show a longitudinal sectional view through a schematically illustrated locking cylinder 50 and a top view of a schematically illustrated locking cylinder 50. Plural scanning elements 57 are formed in the cylindrical core. The scanning elements are radially arranged relative to the base profile 55. In particular, the elements 57 are arranged on a helical path. The helical path extends along the base profile 55 of the cylinder core 52. The scanning elements 57 are in particular configured for scanning the coding elements 40.

FIGS. 4*a* through 4*c* illustrate a coupling element 60. The coupling element 60 is used for scanning a key tip 70 of a key shank 10. The key tip 70 is configured in particular as a partial section of the torsion section 20. Thus, the coupling element 60 scans the twisted tip 70 of the key shank 10. Advantageously the coupling element is configured so that the tip 70 is scannable over its entire length.

This is illustrated in particular in FIG. 4*c*. The tip 70 can penetrate up to the dashed section 61 of the coupling element 60 so that the coupling element 60 scans an entire length of the tip 70. It is appreciated that the tip 70 of the key shank 10 does not have to be pointed. The key tip 70 can also be configured as a flat surface.

FIG. 4*b* illustrates a top view of a coupling element 60. The coupling element 60 has a shape that is complementary to a torsion section or to the shape of the key tip 70 that is produced by the torsion. Thus, the coupling element 60 does not have a straight opening but a curved opening 65.

Overall the geometric match of the locking cylinder 50 or the coupling element 60 relative to the key shank 10 provides a three-dimensional precisely fitted insertion of the key shank 10 into the cylindrical core 52. This facilitates a three-dimensional coding function.

REFERENCE NUMERALS AND DESIGNATIONS

10 Key shank
15 First section
20 Torsion section
22 Profile element
25 Start torsion section
26 Base cross-section
30 Cross-section
35, 35', 35" Edge
38 Flank
40 Coding element
50 Locking cylinder
52 Cylindrical core
55 Base profile
57 Scanning element
60 Coupling element
61 Section
65 Opening
70 Tip
A Length of the key shank in the torsion section
L Longitudinal axis key shank
α Torsion angle
ω Torsion angle

The invention claimed is:

1. A key, comprising: a key head; and a key shank (10), characterized in that the key shank (10) includes a first section that is adjacent to the key head and a torsion section (20) that adjoins the first section and is formed, in particular cold formed, along a longitudinal axis (L) at least in sections, wherein the key shank (10) includes a base cross-section (26) in a transition portion to the torsion section (20), wherein a cross-section (30) of the key shank (10) protrudes at least in sections beyond the base cross-section (26) in the torsion section (20) in a direction towards the key tip (70), wherein the key shank (10) includes at least one profile element (22) that is configured as a longitudinal groove, wherein the profile element (22) also includes a torsion in the torsion section (20), wherein the key tip (70) is formed as a portion of the torsion section (20) and is continuously twisted about the longitudinal axis (L) of the key shank, and wherein the key tip (70) is not congruent to the first section of the key shank.

2. The key with the key head and the key shank (10) according to claim 1, characterized in that a length (A) and a torsion angle (ω) of the key shank (10) is variable in the torsion section (20) in the direction towards the key tip.

3. The key according to claim 1, characterized in that the torsion section (20) is configured as a control curve or includes a control curve.

4. The key according to claim 1, characterized in that at least one flank (38) and/or an edge (35) of the key shank (10) protrudes beyond the base cross-section (26).

5. The key according to claim 1,
characterized in that
the key shaft (10) includes at least one coding element (40) that is configured in particular as a recess in an edge (35).

6. The key according to claim 1,
characterized in that
at least two profile elements (22) that extend parallel to one another in a first section (15) that starts at the key head are twisted about the longitudinal axis (L) of the key shank (10) in an adjoining torsion section (20) and are advantageously arranged double helix-shaped.

7. The key according to claim 6,
characterized in that
at least the key shank (10) is made from an elastic material.

8. The key according to claim 7,
characterized in that
at least the key shank (10) is made from one of spring steel and polyurethane.

9. The key according to claim 8,
characterized in that
at least the key shank (10) is made from PUR D 44.

10. The key according to claim 1,
characterized in that
the key shank (10) is rotatably supported in the key head.

11. A lock, in particular configured to receive the key according to claim 1, wherein the lock includes a locking cylinder (50) with a cylinder core (52),
characterized in that
at least one decoding element is configured in the cylinder core (52), wherein the decoding element includes an arcuate, in particular helical, contour at least in sections, or the decoding element is arranged on an arcuate, in particular helical, path.

12. The lock, according to claim 11,
characterized in that
the arcuate, in particular helical path, extends along a base profile (55) of the cylinder core (52).

13. The lock according to claim 11,
characterized in that
plural decoding elements configured as scanning elements (57) are arranged on a helical path.

14. The lock according to claim 11,
characterized in that
at least one decoding element is configured as an arcuate, in particular helical, protrusion, or as an arcuate, in particular helical, recess.

15. The lock according to claim 11,
characterized by
a coupling element (60) which scans the tip (70), in particular the tip associated with the torsion section (20).

16. A locking system, comprising: the lock according to claim 11.

17. A locking system, comprising: the key according to claim 1.

* * * * *